United States Patent [19]

Matthews

[11] 4,143,609

[45] Mar. 13, 1979

[54] METHOD OF USING LINKING MACHINES

[75] Inventor: Denis Matthews, Sutton in Ashfield, England

[73] Assignee: Mathbirk, Limited, England

[21] Appl. No.: 805,405

[22] Filed: Jun. 10, 1977

[30] Foreign Application Priority Data

Jun. 17, 1976 [GB] United Kingdom ..... 25166/76

[51] Int. Cl.[2] ..... D05B 1/00; D05B 7/00

[52] U.S. Cl. ..... 112/262; 112/25

[58] Field of Search ..... 112/25, 26, 27, 163, 112/262

[56] References Cited

U.S. PATENT DOCUMENTS

| | | | |
|---|---|---|---|
| 1,587,957 | 6/1926 | Huber | 112/163 X |
| 3,051,104 | 8/1962 | Graves | 112/25 |
| 3,119,360 | 1/1964 | Mayer | 112/163 X |
| 3,487,797 | 1/1970 | Peloggio | 112/27 |

*Primary Examiner*—H. Hampton Hunter

*Attorney, Agent, or Firm*—Paul & Paul

[57] ABSTRACT

A method of using linking machines is described wherein a linking machine having a pair of needles operating on fabric impaled onto radially extending points around the dial of a linking machine is used so that the first needle to operate on the fabric is adapted to engage the fabric between adjacent points and slightly above while the second of the said needles is adapted to engage the loops of fabric impaled on said points.

1 Claim, 1 Drawing Figure

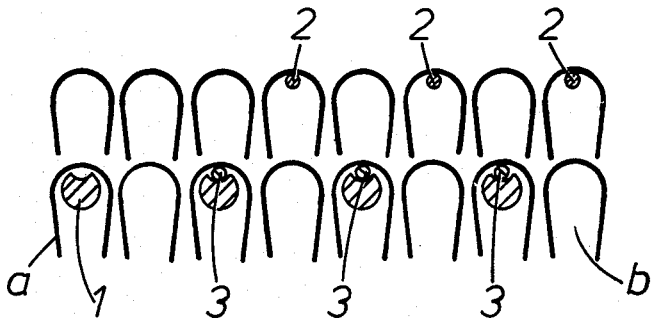
2
2
2
a
1
3
3
3
b

METHOD OF USING LINKING MACHINES

This invention is for improvements in or relating to the use of linking machines. Linking machines of the kind to which the present invention relate are described in the specification of our U.K. Pat. No. 1,016,531 as well as in the specification of the co-pending application of Ronald George Berkmanshaw, Ser. No. 803,518, filed June 6, 1977.

A linking machine is a machine used for linking together two and sometimes more pieces of fabric primarily to form a garment. It is known to provide a linking machine which has a pair of needles operating sequentially so as to form a secure stitch joining the fabric together, thus ensuring that at least one of the needles will engage into the loops of the fabric to be linked.

To do this it has been the practice to ensure that one of the needles operates in line with the points on to which the fabric to be linked is impaled, and the other of the needles operates between adjacent points, thus ensuring that those loops which are accurately impaled on the points will be linked by the first mentioned needle and any loops which may not be accurately impaled will be engaged and linked by the second of the referred two needles.

When linking pieces of fabric to form shoulders, or arms it will be appreciated that it is not essential for the fabric to be linked accurately along the loops on which they are impaled on the points, and it is therefore customary to arrange for needles of a twin needle linking machine to engage the fabric slightly above the points thereby introducing the possibility that the needle engages the loop above the loop which is impaled onto a point. For internal seams used in arms and shoulders, such an arrangement is satisfactory.

In some instances an oversewing stitch is formed over the join of the two pieces of fabric in order to make a neater and even more secure join on the fabric.

However in the linking together of pieces of fabric to form necklines where the linking stitch will be seen on a garment such as for example pullover or sweater or other outerwear garment it will be appreciated that not only is it essential for the pieces of fabric of the same length to be accurately linked but the linking stitch itself must not form any obtrusive or unsightly presentation of the garment. It is therefore essential that the linking of the fabric together shall be accurately performed along the loops which are to be joined together.

Hitherto it has been the practice to link garments for necklinings and similar on a single needle machine, which needle engages down the points so as to engage in the loops which are impaled on the points.

It will be appreciated that to ensure that all the loops to be linked are accurately impaled on the points that a highly skilled operator is necessary to run the fabrics onto the points accurately for all the loops to be impaled thereon and ensuring that none of the loops are missed or that the points do not engage the thread or the fabric between adjacent loops. It requires considerable practice and skill and expertise as well as manual dexterity in order to ensure that a fabric is accurately impaled on the points in this manner.

It is an object of the present invention to provide a method of using a two needle linking machine whereby the fabric to be linked may be impaled onto the points in such manner as to ensure that the fabric when linked presents a satisfactory appearance even around neck and similar places.

Accordingly the present invention provides for a method of using a linking machine having a pair of needles operating on fabric impaled onto radially extending points around a dial of a linking machine wherein the first needle to operate on the fabric is adapted to engage the fabric between adjacent points and slightly above while the second of the said needles is adapted to engage the loops of fabric impaled on said points.

It has been found that if the first of the needles of the two needle linking machines serves the purpose of engaging the loop of the fabric impaled on the points and the second of the needles is adapted to engage between the points that the line of stitches formed by said needles tends to move upwardly and for the linking thereby to become thickened causing in necklines an unsightly appearance.

It will therefore be appreciated that the present invention provides for the first of the two needles of a two needle linking machine, to engage the fabric between the points and slightly above while the second engages the loops of this fabric impaled on the points that the difference in appearance of a fabric linked on a machine according to the method of the present invention as opposed to a machine in which the first needles links the fabric down the points is remarkable and a very substantial and marked improvement in the effect of linking and using the machines according to the method of the present invention is immediately apparent.

It will also be appreciated that by the method of the present invention it becomes possible for relatively unskilled labour with a minimum of training to run the fabric onto the points of a linking machine, even for such operation as the linking of necklinings into a neck opening for a pullover, sweater or similar. By the use of relatively unskilled labour and by the use of a two needle linking machine the speed at which this operation may be performed is both substantially increased as well as the costs per unit for said operation substantially reduced.

Reference is now made to the accompanying drawing which is schematic view of fabric impaled on the radially extending points of a linking machine.

In the drawing the radially extending points of a linking machine such as that disclosed in U.S. Ser. No. 803,518, filed June 6, 1977, are illustrated at 1 and loop fabric is impaled thereon. The fabric is substantially shown as having rows of loops, a and b. The row a being impaled on the points while the row b is between the points. In practice the fabric will not be so uniformly impaled on points. There may be instances where adjacent rows are impaled on adjacent points or instances where more than one row is located between adjacent points.

The fabric to be linked is pierced by a needle at 2, that is above the points and between adjacent points. The needle at 2 forms a single thread chain stitch to secure the fabric together. A second needle then pierces the fabric at 3; that is the needle engages the loop impaled on the points and similarly forms a single thread chain stitch according to known techniques.

What we claim is:

1. The method of linking fabric on a linking machine having a dial with radially extended points characterised in that the method comprises impaling the fabric to be linked on to said points, operating on the fabric with a first needle adapted to form a single chain stitch by said needle engaging the fabric above and between adjacent points, and operating on the fabric with a second needle adapted to form a single thread chain stitch by said second needle engaging the loops of the fabric impaled on the points.

* * * * *